US005147051A

United States Patent [19]

Liljedahl

[11] Patent Number: 5,147,051

[45] Date of Patent: Sep. 15, 1992

[54] HOISTING DEVICE FOR INDIVIDUALS

[76] Inventor: Gunnar Liljedahl, Alvik 7555, S951 50 Lulea, Sweden

[21] Appl. No.: 710,806

[22] Filed: Jun. 5, 1991

[30] Foreign Application Priority Data

Jun. 6, 1990 [EP] European Pat. Off. ..... 90850229

[51] Int. Cl.[5] ..... A61G 7/14; B66C 17/00

[52] U.S. Cl. ..... 212/214; 5/81.1; 5/88.1; 212/218; 212/213

[58] Field of Search ..... 5/81.1, 83.1, 86.1, 5/87.1, 88.1; 212/214, 205, 213, 215, 216, 218; 414/921

[56] References Cited

U.S. PATENT DOCUMENTS 4,125,907 11/1978 Juninger et al. ..... 5/81.1

FOREIGN PATENT DOCUMENTS 7917226 6/1979 Fed. Rep. of Germany .
8903819 7/1989 Fed. Rep. of Germany .
2414907 8/1979 France ..... 5/83.1
426287 12/1982 Sweden .

*Primary Examiner*—Alexander Grosz

*Attorney, Agent, or Firm*—Davis Hoxie Faithfull & Hapgood

[57] ABSTRACT

A hoisting device for individuals includes a hoisting band which can be elevated and lowered in the vertical direction. The hoisting device comprises an elongated bracket on which a driving device is attached. The driving device is arranged to displace a pivot backwards and forwards. A band runs from an attachment to the bracket around a movable guide roller and around a pulley wheel down into a loop on which the individual is attached. While being displaced, the pivot moves the guide roller, thus extending the band in the longitudinal direction of the bracket and thereby retracting the loop. The driving device is a linearly operating electric motor. In order to improve the hoisting possibilities, a trolley is arranged to be able to freely run along the continuous bracket whereby the band, which runs from the trolley on a first guide pulley and downwards in order to form a loop under the continuous bracket and up on a second guided pulley, moves with the trolley. The second end of the band is secured to the continuous bracket.

2 Claims, 3 Drawing Sheets

HOISTING DEVICE FOR INDIVIDUALS

BACKGROUND OF THE INVENTION

1. Field of the Invention

This invention concerns a hoisting device for hoisting individuals. More particularly, the present invention relates to a hoisting device which is mounted on a ceiling, a wall or a stand whereby an individual, such as a patient, can be raised and lowered in a vertical plane and can be moved back and forth along the length of the hoisting device while maintaining a constant height.

2. Prior Art

Hoisting devices are known in the art. SE-A 7811656-3 (publication No. 426,287) discloses a device which permits the vertical movement of a patient. However, to use this device, the patient must be correctly aligned directly beneath the hook of the hoist. This is often difficult since patients often have restricted movements or are wheelchair-bound. Further, this prior art hoist is only capable of moving the patient up and down. There is no described way to move the patient horizontally.

It is an object of the present invention to improve such a hoisting device so that the point from which the hoisting device performs the movement upwards or downwards can be positioned along a continuous bracket of the hoisting device. This results in another degree of motion when this hoisting device is used. This invention also eliminates the necessity of moving a patient to a particular location in order to be hoisted. Rather, a loop from the hoisting device which is fixed around the patient's chair or harness is moved to the position of the patient.

SUMMARY OF THE INVENTION

The present invention relates to a hoisting device for individuals, and especially patients.

A bracket for the hoisting device is mounted on a ceiling, a wall or on a stand, higher than the patient. A hoisting band is attached at the front of the bracket, runs back and forth along the length of the bracket between a series of pulleys, down through a trolley and up again, and is attached to the rear of the bracket. The band is long enough so that the excess length extends down through the trolley in a loop. The patient is harnessed to this loop, or the loop is hooked onto the patient's chair. By changing the size of the loop, the patient is raised or lowered. By moving the trolley back and forth along the bracket, the loop is moved back and forth but the loop itself remains the same size. Consequently, the patient is not raised and lowered.

The length of the loop is changeable because the band is extended over a pulley arrangement. When the pulleys are pulled apart, more band length is required to reach over them. Therefore, less band length exists for the loop and the loop retracts.

One set of pulleys, "pulley wheels", are mounted on the bracket. Another set of pulleys, "guide rollers", are mounted on a slide within the bracket. This slide is connected to a piston which runs through the bracket. The piston is moved back and forth within the bracket by a driving means. The driving means consists of a linearly operating electric motor including at least one screw means forming a part of the piston.

As the driving means is activated by an operator, such as a nurse or physical therapist, the piston is moved toward or away from the pulley wheels. This moves the slide correspondingly toward or away from the pulley wheels. As a result, the guide rollers mounted on the slide move toward or away from the pulley wheels. This increases or decreases the length of band needed to wrap around the pulley arrangement, and, inversely, the amount of band length left for the loop. Consequently, the patient is lowered and raised.

The loop is formed by the band when the band extends down through the trolley and back up again. Mounted within the trolley are two guide pulleys. The band extends over one guide pulley, down to the patient, and back up over the other guide pulley. The trolley itself rests on guide rails that extend the length of the bracket. As the trolley is moved along the bracket, the band is free to roll over the pulleys and thus allow the loop to remain directly beneath the trolley as the trolley moves the length of the bracket. Since the length of the band is not affected by this movement, the height of the loop does not change and the patient remains elevated at a constant height.

DETAILED DESCRIPTION

Figure 1:
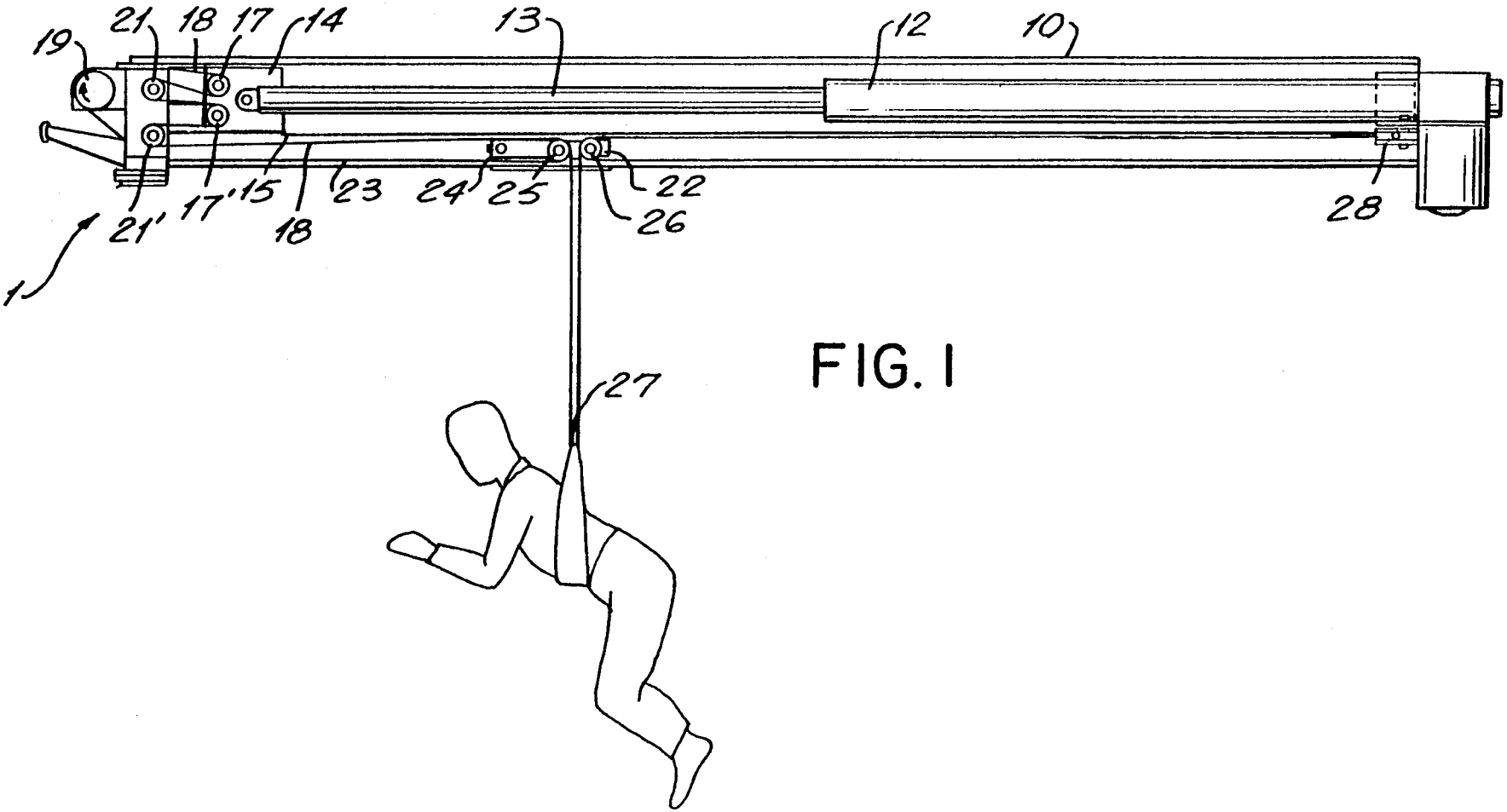
FIG. 1 is a sideview, partly in section, showing the hoisting device with the loop in a lowered position, which can be mounted on a wall or the ceiling of a room or on a stand.

Referring to FIG. 1, the hoisting device 1 comprises a bracket, which in the preferred embodiment, is a hollow beam 10 which can have either a square cross section or a circular cross section, and which is securely mounted at the top of the beam to a ceiling or wall (not shown) by attachment means well known in the art (not shown). Alternatively, the beam may be supported by a stand (see FIG. 3).

A linearly operating electric motor 12 is mounted within the beam 10. A piston 13 is mounted on the motor, which piston is displaceable in the longitudinal direction of the beam by the motor. The other end of the piston is mounted to a slide 14. The slide 14 is displaced in the beam 10 in the beam's longitudinal direction as the piston is displaced by the motor. The slide 14 moves in guides 15 (shown schematically). The slide's movement on the guides can be made easier by means of wheels or sliding bodies (not shown), which are well known in the art. The load on the guides in the vertical direction is, however, not affected by the weight carried by the hoisting device 1.

A pair of guide rollers 17,17' are mounted on bearings in the slide 14. A pair of pulley wheels 21,21' are mounted on bearings in the beam 10 but in front of the slide 14. One end of a hoisting band 18 is attached to the front end 32 of the beam 10 by an attachment means 19, 19'. The band 18 extends within the beam 10 from the attachment 19, 19' toward the motor 12, around the upper guide roller 17 (a distance $l_1$), back toward the front end of the beam, around the upper pulley wheel 21 (a distance $l_2$), back toward the motor 12, around a lower guide roller 17' on the slide 14 (a distance $l_3$), and thereafter toward the front of the beam and around a lower pulley wheel 21' (a distance $l_4$). The known technique teaches that the band 18 then should run from the lower pulley wheel 21' downwards where a harness or a chair would be carried by the free end of the band in order to hoist a patient. As the slide 14 is moved by the motor 12 away from the front of the beam 10, the distances $l_1$, $l_2$, $l_3$, $l_4$ increase. Consequently, a larger portion of the band length is required to extend over the pulleys and rollers therefore, less length remains to extend beyond lower pulley wheel 21', and the patient is hoisted.

According to the present invention, hoisting from different positions along the beam 10 is made possible by use of a trolley 22 which is moveable along the beam. The trolley 22 rides upon wheels 24 along guide rails 23. The guide rails 23 may either be a part of the bottom of the beam 10 (shown in FIGS. 1 and 2) or may be mounted underneath the beam 10. An opening which runs the length of the beam is formed between the guide rails 23 in the underside of the beam. This opening is of sufficient width so that the band 18 can fit therethrough.

The trolley 22 has a first and second guided pulley, 25 and 26, respectively. The band 18 runs from the lower pulley wheel 21' toward the trolley 22, around the first guided pulley 25 and downwards through the opening in the beam 10. The band forms a loop 27 under the beam and then runs upwards and around the second guided pulley 26. The band then extends toward the rear of the beam 10 where it is mounted to the beam by an attachment means 28.

When the motor 12 is operated, the piston 13 is displaced toward either the front 32 or the rear 33 of the beam 10. The piston thereby moves the slide 14, to which it is fixedly attached, toward the front 32 or rear 33 of the beam 10.

When the slide 14 is moved backwards and forwards by the piston 13, the guide rollers 17,17' are moved away from and toward, respectively, the pulley wheels 21,21' which are fixedly mounted on the beam 10. Consequently, the lengths $l_1$, $l_2$, $l_3$, $l_4$ over which the band 18 extends are increased and decreased, respectively. As the guide rollers 17, 17' move away from the pulley wheels 21, 21', more length of the band 18 is required to reach over them. Consequently, less band length remains for the loop 27 and the loop retracts toward the beam. As the guide rollers 17, 17' are moved toward the pulley wheels 21, 21', less length of band 18 is required to reach over them. Consequently, more band length remains for loop 27, and the loop extends away from the beam.

Figure 2:
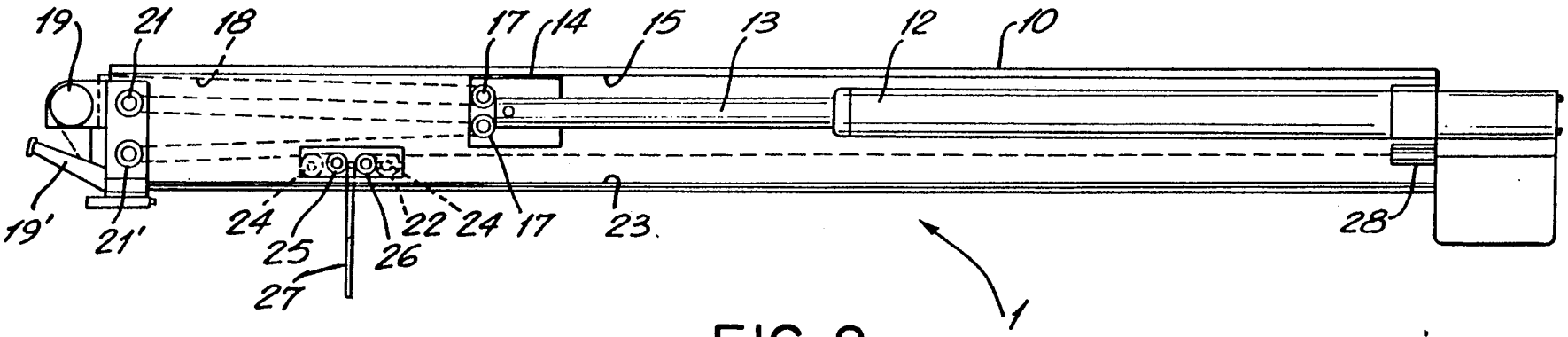
FIG. 2 is a sideview, partly in section, showing the hoisting device of FIG. 1 with the loop in a raised position.

The operation of this device can be seen by comparing FIG. 1 with FIG. 2. In FIG. 1, the slide 14 is positioned near the front of the beam. Therefore, the guide rollers 17, 17' are near the pulley wheels 21, 21' and the lengths $l_1$, $l_2$, $l_3$, $l_4$ are short. A small proportion of band length is required to reach over the pulleys and rollers, resulting in a larger amount of band length remaining from forming the loop 27. The larger loop 27 means the bottom of the loop, i.e., where the patient is attached, is further from the beam 10, i.e., lower.

In FIG. 2, the slide 14 is positioned further from the front of the beam 10. Therefore, the guide rollers 17, 17' are further from the pulley wheels 21, 21' and the lengths are $l_1$, $l_2$, $l_3$, $l_4$ longer. A larger portion of the band length is required to reach over the pulleys and rollers, resulting in a smaller amount of band length remaining for forming the loop 27. The shorter loop 27 means the bottom of the loop, i.e., where the patient is attached, is nearer the beam 10, i.e., high. As seen in comparing FIGS. 1 and 2, the patient in FIG. 1 is lower than the patient in FIG. 2 due to the change in the size of the loop 27.

The loop 27 can be moved along the length of the beam 10 at a fixed height by moving the trolley 22 along its guide rails 23. Because the slide 14 is in a fixed position with respect to the pulley wheels 21, 21', the lengths $l_1$, $l_2$, $l_3$, $l_4$, will not change, the loop 27 will not change its length and the patient will remain at a fixed height. The band 18 will be free to roll over the guided pulleys 25, 26. In this way, the loop will remain under the trolley 22 as the trolley moves the length of the beam 10. However, it is also clear that the trolley 22 can be displaced along its guide rails 23 simultaneously with a displacement of the slide 14 if so desired. The vertical load is carried by the trolley 22. The slide 14 is mainly affected by horizontal forces from the band 18 applied through the guide rollers 17, 17'.

According to the preferred embodiment, there are two guide rollers 17,17' and two pulley wheels 21,21' in order to obtain the mechanical advantage of these devices. It is within the scope of the present invention to extend the band by using only one guide roller 17 and one pulley wheel 21. This will require a more powerful motor 12 to change the loop 27 the same amount.

There is shown an attachment means 19, 19' for one end of the band 18. This attachment means can comprise a means in which the band is reeled in, such as a winch 19 having a releasable locking device 19' which under normal operation prevents the band from unreeling from the winch. When the hoisting device 1 is operating normally, this means 19, 19' for unwinding the band 18 is locked so that the band is of a fixed length. If, however, for some reason the electric motor 12 is not operable, e.g., because of power failure, the hoisting means 1 can still operate in one direction to lower the loop 27. The attachment means 19, 19' can be manually unlocked, allowing the band to unreel. This results in loop 27 extending down toward the floor.

Figure 3:
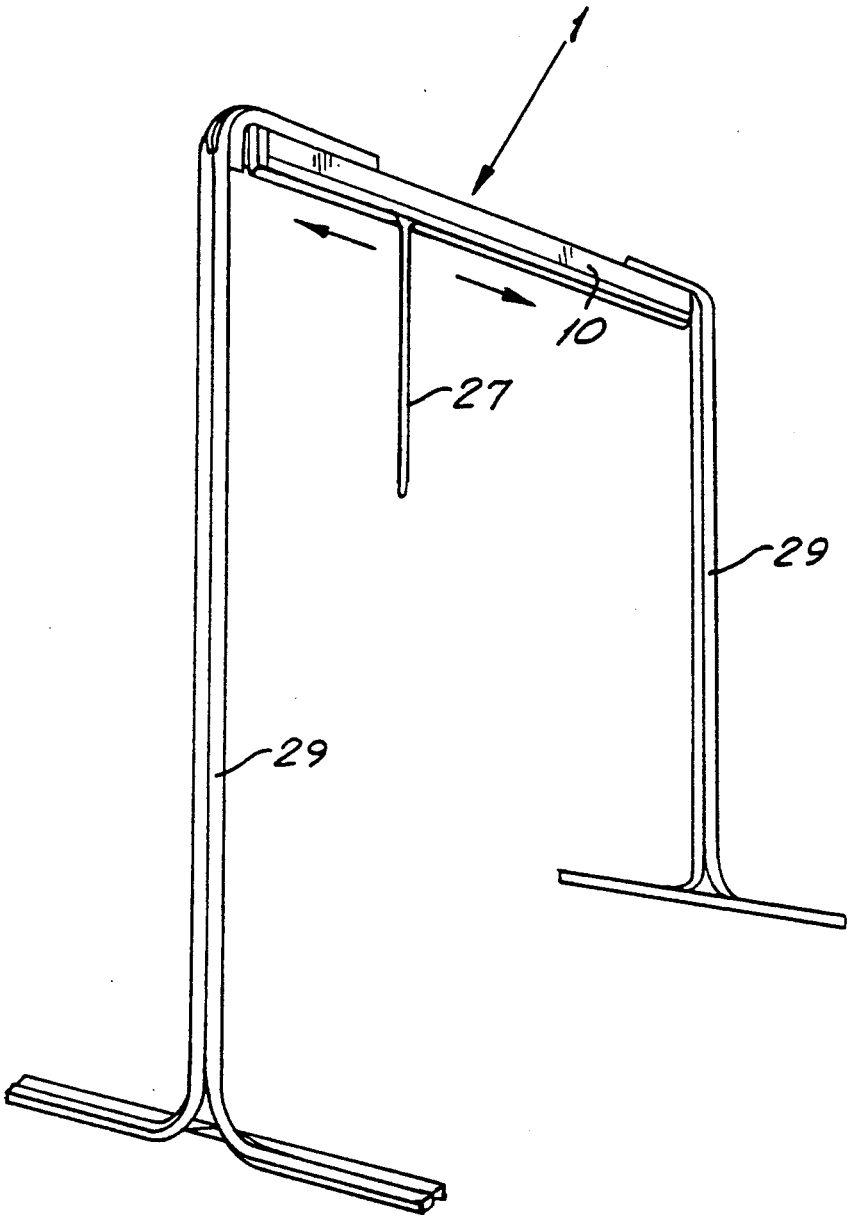
FIG. 3 is a perspective view of the hoisting device of FIG. 1 mounted on a stand.

FIG. 3 shows the beam 10 attached at both ends to stands 29. The beam 10 is attached to the stands 29 by some known means such as by being bolted to the stands. It should be known that the beam 10 could be directly bolted to ceiling or a wall, as long as it is located above the patient.

What is claimed is:

1. A hoisting device, preferably for hoisting individuals, whereby the hoisting device is mounted on an higher level than that at which the individual is situated, comprising:

a bracket having a first end and a second end which can be mounted on a wall, a ceiling or a stand; a driving means mounted on the bracket at the first end of the bracket;

a piston mounted within the bracket, attached to the driving means whereby the driving means can displace the piston longitudinally within the bracket;

a slide mounted within the bracket which is free to slide longitudinally within the bracket; and wherein the slide is fixed to an end of the piston which is not attached to the driving means; and whereby the slide is moved by the piston as the piston is moved by the driving means;

at least one guide roller mounted on the slide;

at least one pulley wheel mounted on the second end of the bracket;

a trolley mounted on guide rails which guide rails are mounted on the bottom of the bracket such that the trolley can slide along the length of the bracket;

a pair of guide pulleys mounted on the trolley;

a band which is attached at one end near the top of the second end of the bracket by a first attachment means and is attached to the bracket near the first end by a second attachment means;

the band runs from the first attachment means, over and around the guide roller, then runs over and around the pulley wheel, then runs over and around the first guide pulley, down into a loop, up over the second guide pulley, and to the second attachment means; and the loop is extended and retracted by moving the slide toward and away from the guide roller whereby less or more band length is required to reach from the guide roller to the pulley wheel.

2. The hoisting device according to claim 1, wherein the bracket comprises a hollow beam having a slot through its underside along the direction in which the trolley is moved, the band being passed through the slot to form the loop under the beam.

* * * * *